US006407653B1

(12) United States Patent
Zindler et al.

(10) Patent No.: US 6,407,653 B1
(45) Date of Patent: Jun. 18, 2002

(54) CIRCUIT INTERRUPTER WITH A MAGNETICALLY-INDUCED AUTOMATIC TRIP ASSEMBLY HAVING ADJUSTABLE ARMATURE BIASING

(75) Inventors: Mark O. Zindler, Pittsburgh; Joseph B. Humbert, Monaca; David Charles Funyak, Irwin, all of PA (US)

(73) Assignee: Eaton Corporation, Cleveland, OH (US)

( * ) Notice: Subject to any disclaimer, the term of this patent is extended or adjusted under 35 U.S.C. 154(b) by 0 days.

(21) Appl. No.: 09/665,424

(22) Filed: Sep. 20, 2000

(51) Int. Cl.[7] ..... H01H 75/12

(52) U.S. Cl. ..... 335/6; 335/21; 335/38; 335/42; 335/172; 335/174; 335/176

(58) Field of Search ..... 335/6, 21, 38, 335/42, 172, 174, 176

(56) References Cited

U.S. PATENT DOCUMENTS 5,381,120 A * 1/1995 Arnold et al. ..... 335/35

OTHER PUBLICATIONS

U.S. patent application Ser. No. 09/384,148, filed Oct. 27, 1999.
U.S. patent application Ser. No. 09/494,706, filed Jan. 31, 2000.

* cited by examiner

*Primary Examiner*—Ramon M. Barrera
(74) *Attorney, Agent, or Firm*—Charles E. Kosinski

(57) ABSTRACT

A circuit interrupter including a housing, separable main contacts disposed in the housing, and an operating mechanism disposed in the housing and interconnected with the contacts. A trip mechanism is disposed in the housing and has an automatic trip assembly that generates a tripping operation. The automatic trip assembly includes a magnetic yoke, an armature, and a plurality of abutment members. The magnetic yoke has pivot supports providing for a rotatable disposition of a head portion of the armature. The assembly also includes a biasing member having a first portion and a second portion, the first portion abutted against a selected one of the plurality of abutment members, the second portion abutted against the armature and applying a force to the armature in a direction to normally rotationally displace a bottom portion of the armature away from the magnetic yoke, wherein selecting a different one of the plurality of abutment members to be the selected one causes the force to vary.

19 Claims, 10 Drawing Sheets

CIRCUIT INTERRUPTER WITH A MAGNETICALLY-INDUCED AUTOMATIC TRIP ASSEMBLY HAVING ADJUSTABLE ARMATURE BIASING

CROSS REFERENCE TO RELATED APPLICATIONS

The subject matter of this invention is related to the following concurrently filed, co-pending application: U.S. patent application Ser. No. 09/665423, filed Sep. 20, 2000, entitled "Circuit Interrupter With a Magnetically-induced Automatic Trip Assembly Having Improved Armature Pivoting".

BACKGROUND OF THE INVENTION

1. Field of the Invention

The present invention relates to circuit interrupters generally and, more specifically, to those kinds of circuit interrupters having a trip mechanism including an automatic trip assembly for generating a magnetically-induced tripping operation.

2. Description of the Prior Art

Molded case circuit breakers and interrupters are well known in the art as exemplified by U.S. Pat. No. 4,503,408 issued Mar. 5, 1985, to Mrenna et al., and U.S. Pat. No. 5,910,760 issued Jun. 8, 1999 to Malingowski, et al., each of which is assigned to the assignee of the present application and incorporated herein by reference.

Circuit interrupters advantageously provide for automatic circuit interruption (opening of the contacts) when an overcurrent condition is determined to exist. One way of determining whether or not an overcurrent condition exists is to provide a trip mechanism with an automatic trip assembly that reacts to a magnetic field generated by the overcurrent condition. In such circuit interrupters, the reaction to the magnetic field is often in the form of a movement of an armature that, in turn, sets in motion a tripping operation. The movement of the armature normally is either away from or towards a magnetic structure from which the magnetic field emanates, and may be influenced by a member(s) which biases the armature away from the magnetic structure. The magnetic structure is connected to an electrical terminal of the conductor from which electrical current is received.

In the prior art, compression springs have sometimes been implemented in the automatic trip assembly in order to provide the aforementioned biasing of the armature away from the magnetic structure. Unfortunately, in order to adjust the predetermined current level that causes this magnetic tripping operation, a different sized compression spring must be used in the prior art in order to provide a different biasing force. It would be advantageous if a way existed by which to provide armature biasing that enabled the biasing level to be adjusted in an easier and more time-efficient manner.

SUMMARY OF THE INVENTION

The present invention provides a circuit interrupter that meets all of the above-identified needs.

In accordance with the present invention, a circuit interrupter is provided which includes a housing, separable main contacts disposed in the housing, and an operating mechanism disposed in the housing and interconnected with the contacts. Also provided is a trip mechanism disposed in the housing and having an automatic trip assembly that generates a tripping operation to cause the operating mechanism to open the contacts upon a predetermined current threshold. The automatic trip assembly includes a magnetic yoke, an armature, and a plurality of abutment members. The magnetic yoke has pivot supports providing for a rotatable disposition of a head portion of the armature. The assembly also includes a biasing member having a first portion and a second portion, the first portion abutted against a selected one of the plurality of abutment members, the second portion abutted against the armature and applying a force to the armature in a direction to normally rotationally displace a bottom portion of the armature away from the magnetic yoke, wherein selecting a different one of the plurality of abutment members to be the selected one causes the force to vary.

This and other objects and advantages of the present invention will become apparent from a reading of the following description of the preferred embodiment taken in connection with the attached drawings.

DESCRIPTION OF THE PREFERRED EMBODIMENT

Figure 1:
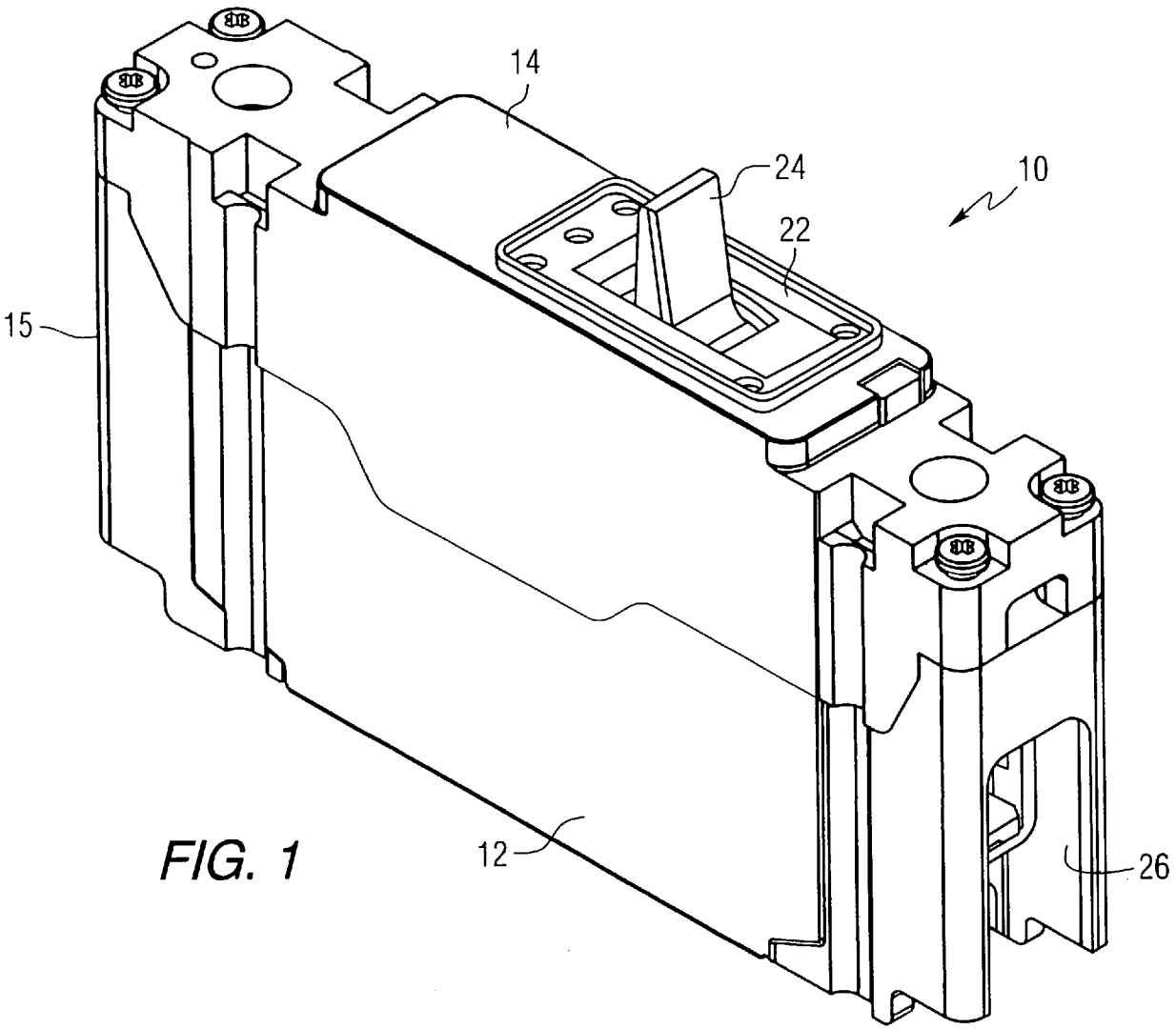
FIG. 1 is an orthogonal view of a molded case circuit breaker embodying the present invention.

Referring now to the drawings and FIG. 1 in particular, shown is a molded case circuit breaker 10. A detailed description of the general structure and operation of circuit breaker 10 can be found in U.S. patent application Ser. No. 09/384,148 and U.S. patent application Ser. No. 09/386,130, both disclosures of which are incorporated herein by reference. Briefly, circuit breaker 10 includes a base 12 mechanically interconnected with a cover 14 to form a circuit breaker housing 15. Cover 14 includes a handle opening 22 through which protrudes a handle 24 that is used in a conventional manner to manually open and close the contacts of circuit breaker 10 and to reset circuit breaker 10 when it is in a tripped state. Handle 24 may also provide an indication of the status of circuit breaker 10 whereby the position of handle 24 corresponds with a legend (not shown) on cover 14 near handle opening 22 which clearly indicates whether circuit breaker 10 is ON (contacts closed), OFF (contacts open), or TRIPPED (contacts open due to, for example, an overcurrent condition). Also shown is a load conductor opening 26 in base 12 that shields and protects a load terminal (not shown). Although circuit breaker 10 is depicted as a single-phase circuit breaker, the present invention is not limited to single-phase operation.

Figure 2:
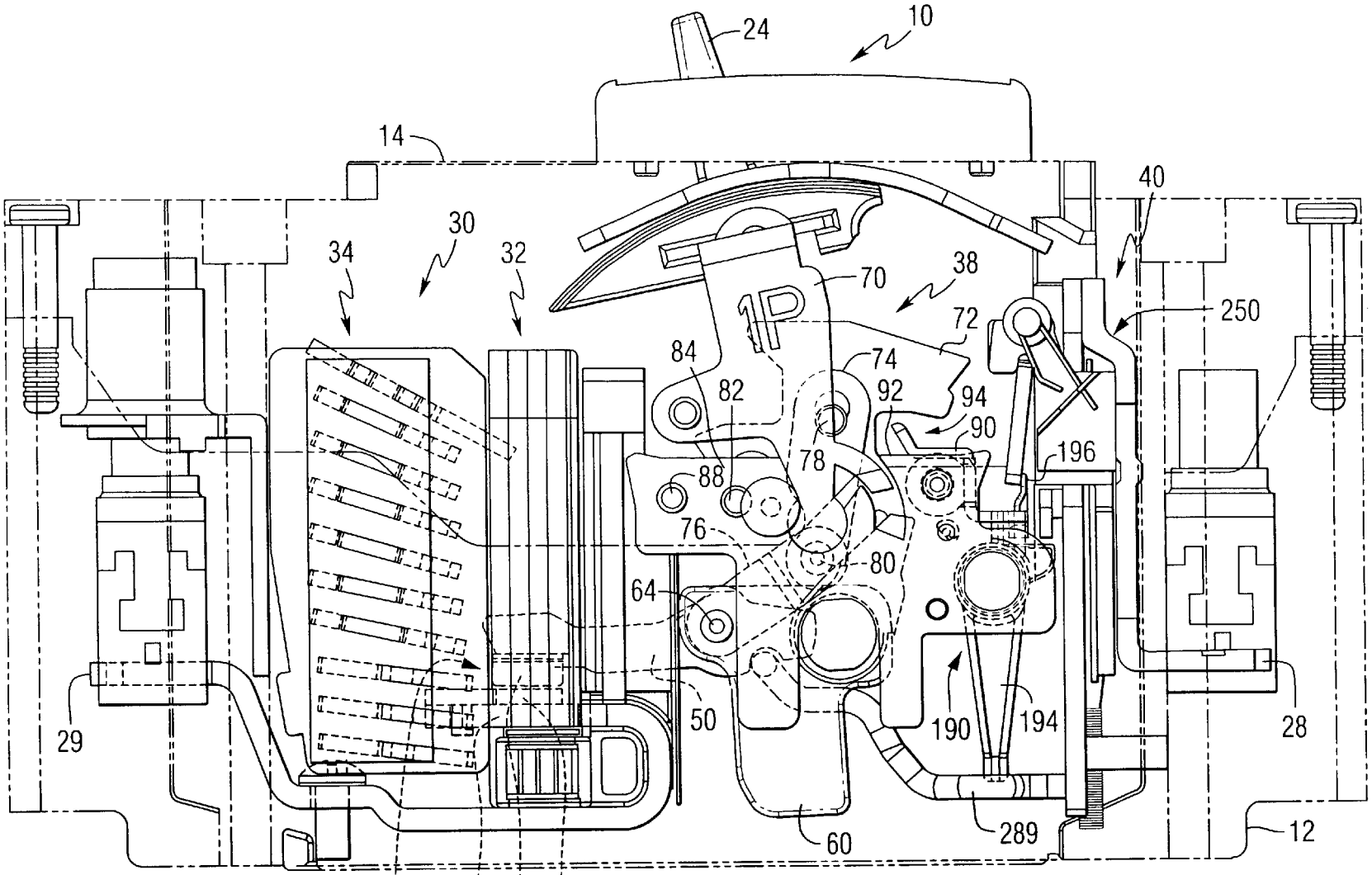
FIG. 2 is a side elevational view of an internal portion of the circuit interrupter of FIG. 1.

Referring now to FIG. 2, a longitudinal section of a side elevation, partially broken away and partially in phantom, of circuit breaker 10 is shown having a load terminal 28 and a line terminal 29. There is shown a plasma arc acceleration chamber 30 comprising a slot motor assembly 32 and an arc extinguisher assembly 34. Also shown is a contact assembly 36, an operating mechanism 38, and a trip mechanism 40 including a rotatable trip bar assembly 190 and an automatic trip assembly 250.

Contact assembly 36 comprises a movable contact arm 50 supporting thereon a movable contact 52, and a stationary contact arm 54 supporting thereon a stationary contact 56. Stationary contact arm 54 is electrically connected to line terminal 29 and movable contact arm 50 is electrically connected to load terminal 28. Also shown is a crossbar assembly 60 which traverses the width of circuit breaker 10 and is rotatably disposed on an internal portion of base 12. Actuation of operating mechanism 38 causes crossbar assembly 60 and movable contact arm 50 to rotate into or out of a disposition which places movable contact 52 into or out of a disposition of electrical continuity with fixed contact 56.

Operating mechanism 38 comprises a handle arm or handle assembly 70 (connected to handle 24), a configured plate or cradle 72, an upper toggle link 74, an interlinked lower toggle link 76, and an upper toggle link pivot pin 78 which interlinks upper toggle link 74 with cradle 72. Lower toggle link 76 is pivotally interconnected with upper toggle link 74 by way of an intermediate toggle link pivot pin 80, and with crossbar assembly 60 at a pivot pin 64. Provided is a cradle pivot pin 82 which is laterally and rotatably disposed between parallel, spaced apart operating mechanism support members or sideplates 84. Cradle 72 is free to rotate (within limits) via cradle pivot pin 82. A main stop bar 88 is laterally disposed between sideplates 84, and provides a limit to the counter-clockwise movement of cradle 72.

In FIG. 2, operating mechanism 38 is shown for the ON disposition of circuit breaker 10. In this disposition, contacts 52 and 56 are closed (in contact with each other) whereby electrical current may flow from load terminal 28 to line terminal 29.

Operating mechanism 38 will assume the TRIPPED disposition of circuit breaker 10 in certain circumstances. The TRIPPED disposition is related (except when a manual tripping operation is performed) to an automatic opening of circuit breaker 10 caused by the thermally or magnetically induced reaction of trip mechanism 40 to the magnitude of the current flowing between load conductor 28 and line conductor 29. The operation of trip mechanism 40 is described in detail below. For purposes here, circumstances such as a load current with a magnitude exceeding a predetermined threshold will cause trip mechanism 40 to rotate trip bar assembly 190 clockwise (overcoming a spring force biasing assembly 190 in the opposite direction) and away from an intermediate latch 90. This unlocking of latch 90 releases cradle 72 (which had been held in place at a lower portion 92 of a latch cutout region 94) and enables it to be rotated counter-clockwise under the influence of tension springs (not shown) interacting between the top of handle assembly 70 and the intermediate toggle link pivot pin 80. The resulting collapse of the toggle arrangement causes pivot pin 64 to be rotated clockwise and upwardly to thus cause crossbar assembly 60 to similarly rotate. This rotation of crossbar assembly 60 causes a clockwise motion of movable contact arm 50, resulting in a separation of contacts 52 and 56.

Circuit breaker 10 includes automatic thermal and magnetic tripping operations which can cause trip bar assembly 190 to rotate in the clockwise direction and thereby release cradle 72. Automatic trip assembly 250 of trip mechanism 40, positioned in close proximity to trip bar assembly 190, enables these tripping operations to be provided.

Figure 3B:
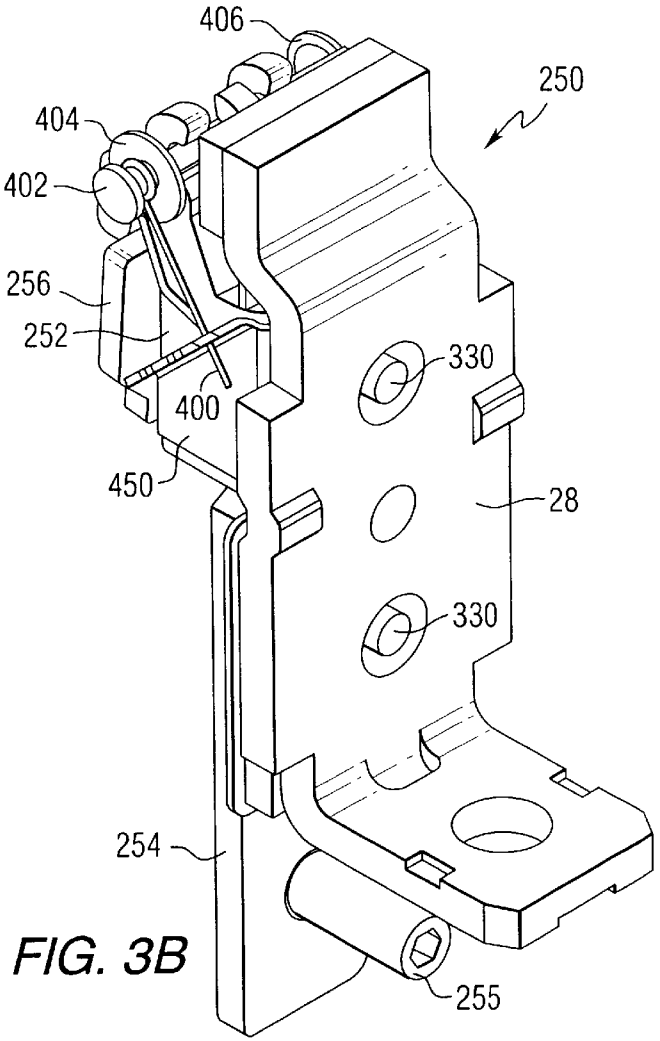
FIGS. 3A, 3B, and 3C are orthogonal views of the automatic trip assembly of the trip mechanism of the circuit interrupter of FIG. 1.
Figure 3A:
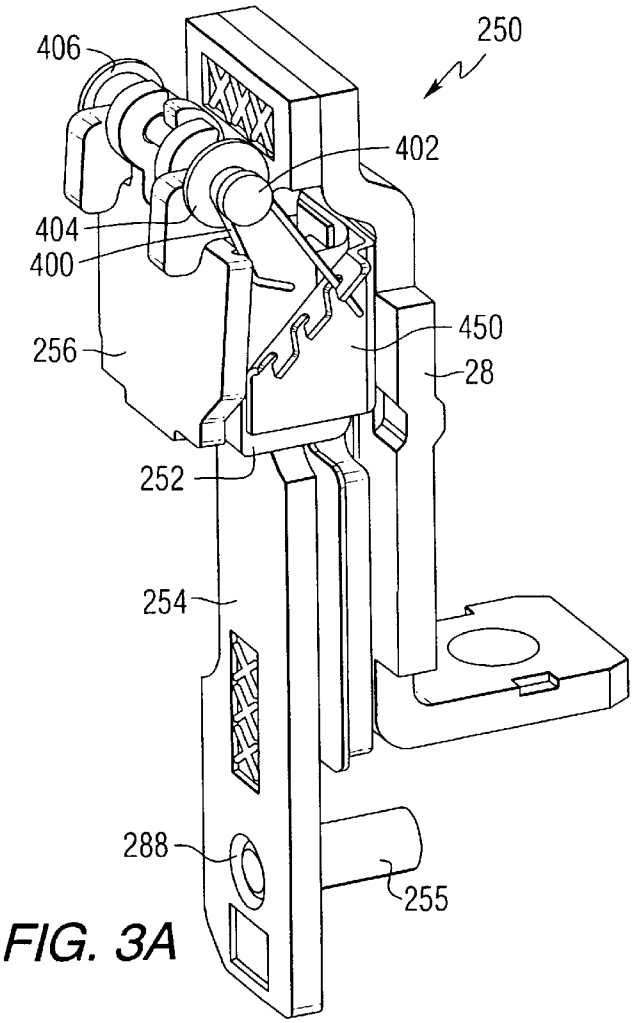
Figure 3C:
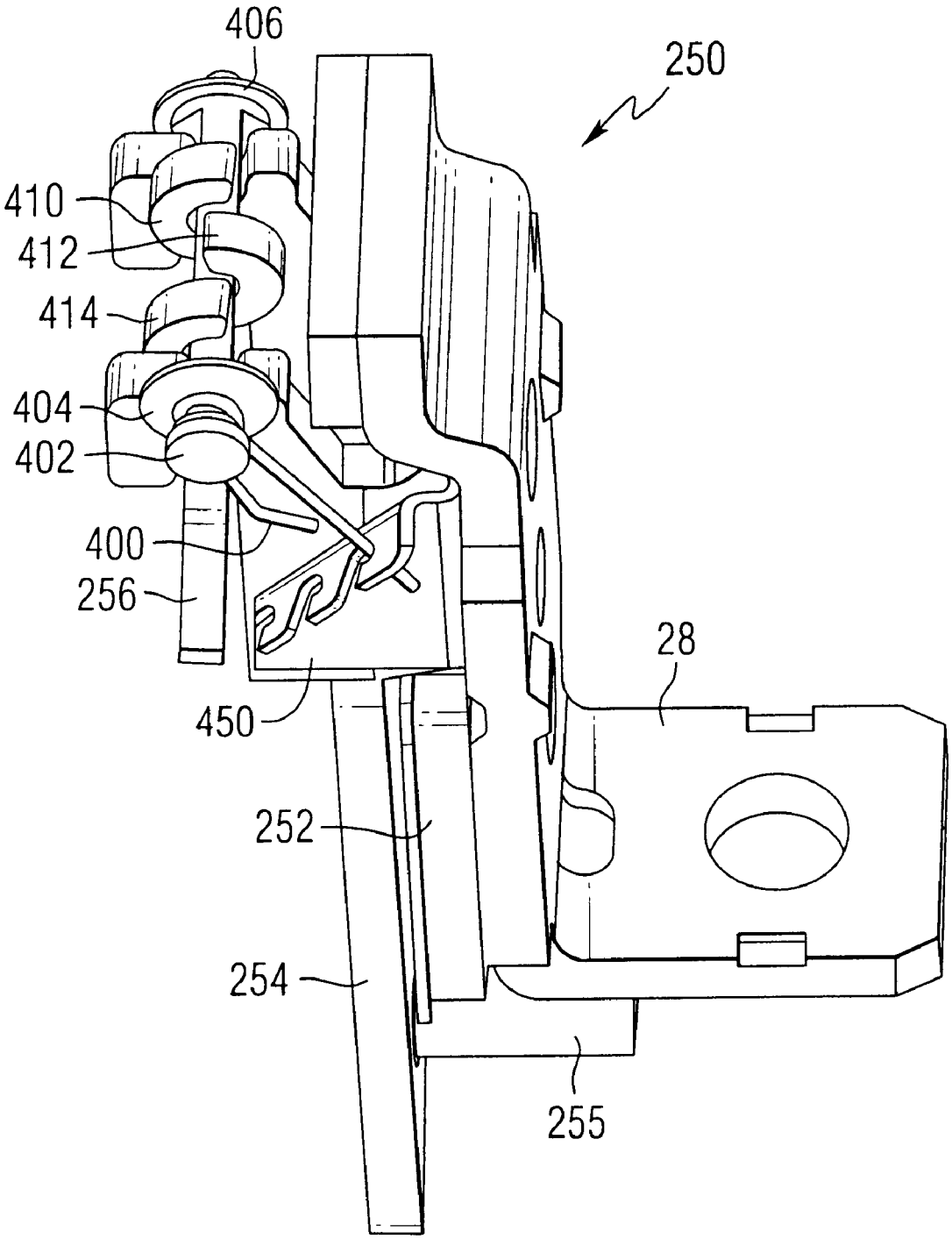

Referring now also to FIGS. 3A, 3B, and 3C, shown in isolation is an assembled automatic trip assembly 250. Assembly 250 includes a magnetic yoke 252, a bimetal 254, a magnetic clapper or armature 256, and load terminal 28. Assembly 250 also includes a torsion spring or biasing member 400, a pivot pin 402, a washer 404, an end cap 406, and a protrusion platform or bracket 450.

Figure 4B:
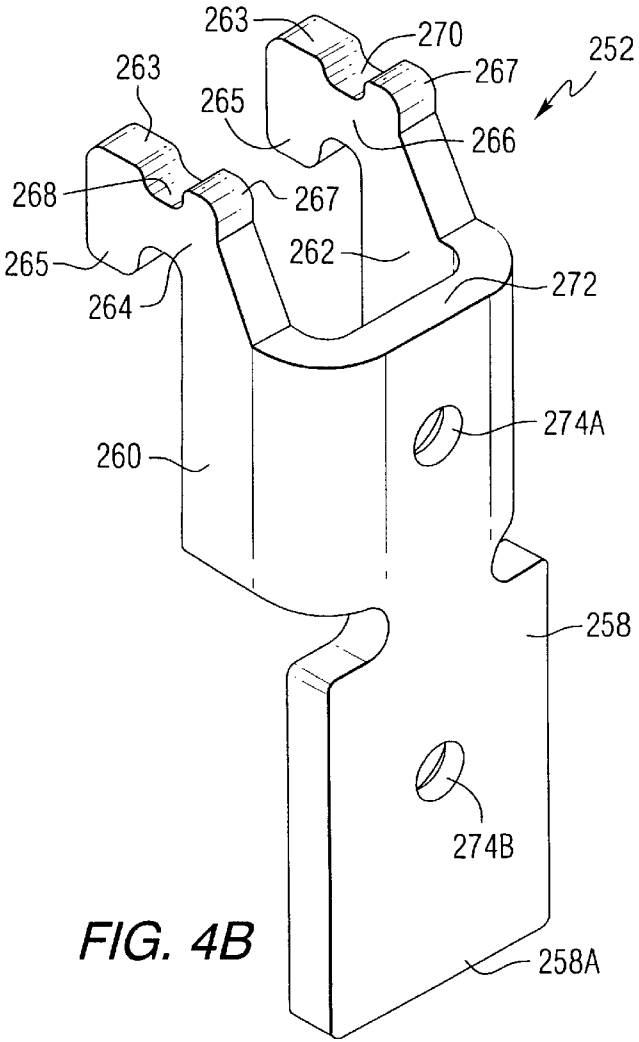
FIGS. 4A and 4B are orthogonal views of the magnetic yoke of the automatic trip assembly shown in FIG. 3A.
Figure 4A:
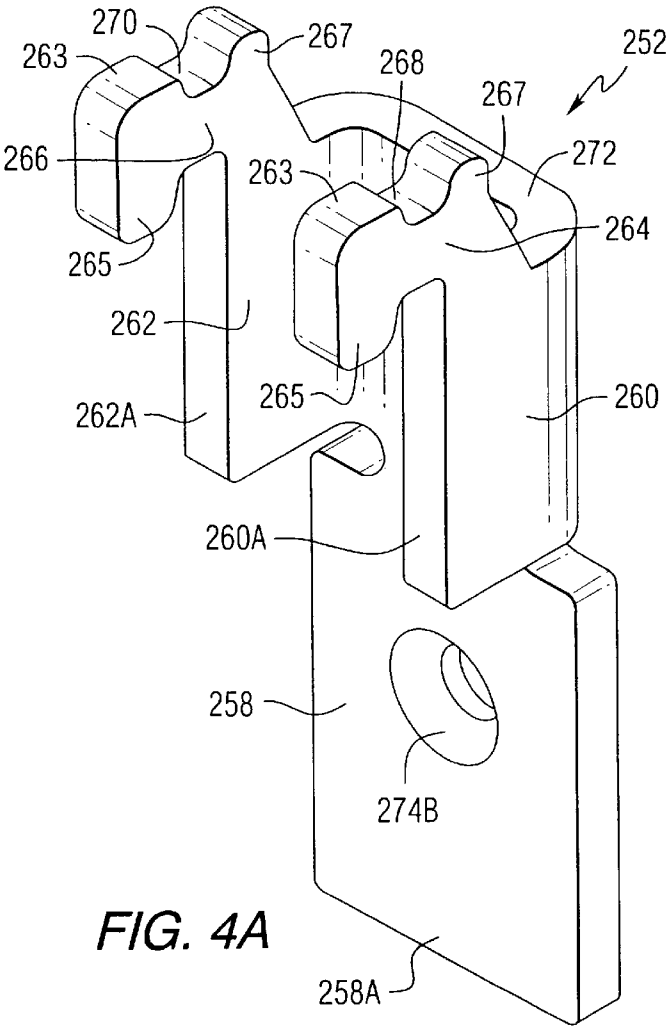

Referring now to FIGS. 4A and 4B, shown in isolation is magnetic yoke 252 of automatic trip assembly 250. Magnetic yoke 252 includes a substantially planar portion 258 with a bottom portion 258A. Protruding from portion 258 are curved arms or sides 260 and 262 having front faces 260A and 262A. At the tops of arms 260 and 262 are pivot supports 264 and 266, with respective pivot surfaces 268 and 270 which provide for a rotatable disposition of magnetic clapper 256, as described below. Pivot supports 264 and 266 each include a front retaining protrusion 263 and a rear retaining protrusion 267 which help define pivot surfaces 268 and 270, and a downwardly facing stop or protrusion 265. Yoke 252 also includes a shoulder portion 272 above which is positioned a portion of load terminal 28, as described below. In addition, holes or openings 274A and 274B are formed through substantially planar portion 258 for purposes described below. Yoke 252 of the exemplary embodiment is made of carbon steel material of approximately 0.078 inch thickness.

Figure 5:
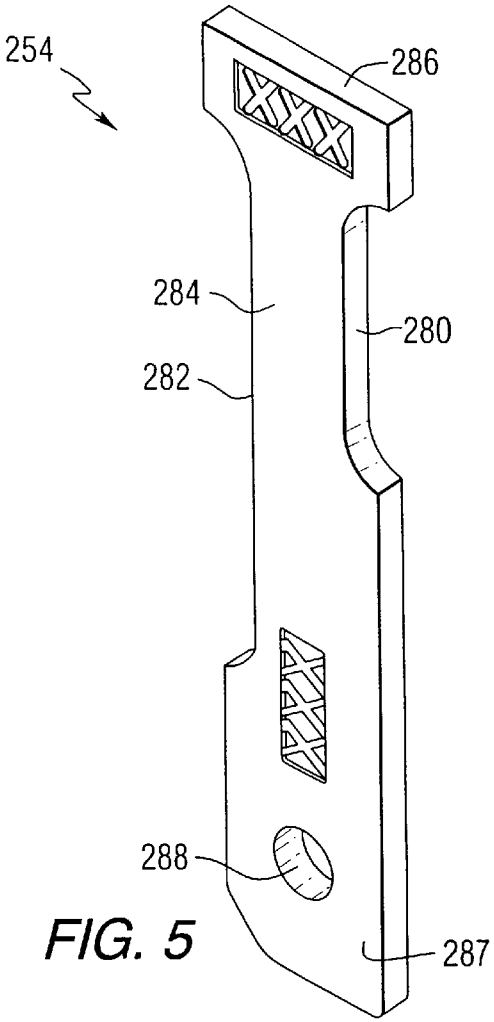
FIG. 5 is an orthogonal view of the bimetal of the automatic trip assembly shown in FIG. 3A.

Referring now to FIG. 5, shown in isolation is bimetal 254 of automatic trip assembly 250. Bimetal 254 is planar and substantially rectangular in form and includes two cutout regions 280 and 282 forming a neck 284 upon which sits a head portion 286. Through a bottom portion 287 of bimetal 254 is a hole or opening 288 for purposes described below. Bimetal 254 is structured as is known to one of skill in the art such that bottom portion 287 deflects (bends) in a conventional manner above certain temperatures.

Figure 6:
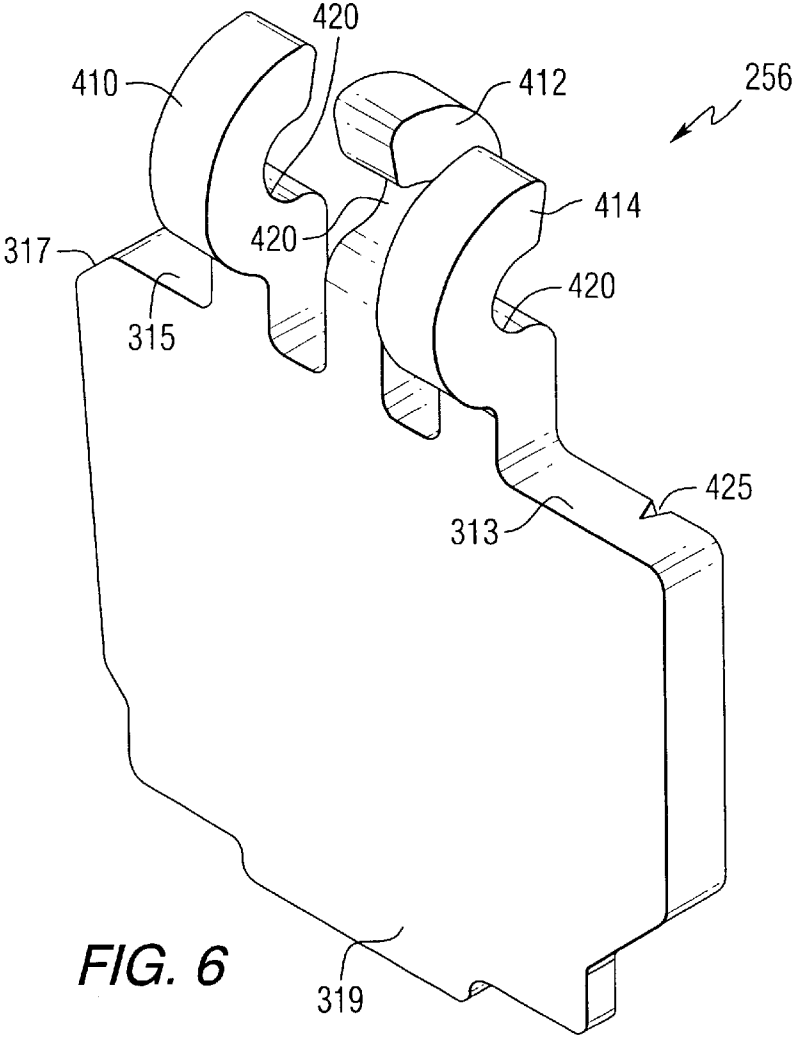
FIG. 6 is an orthogonal view of the armature of the automatic trip assembly shown in FIG. 3A.
Figure 10:
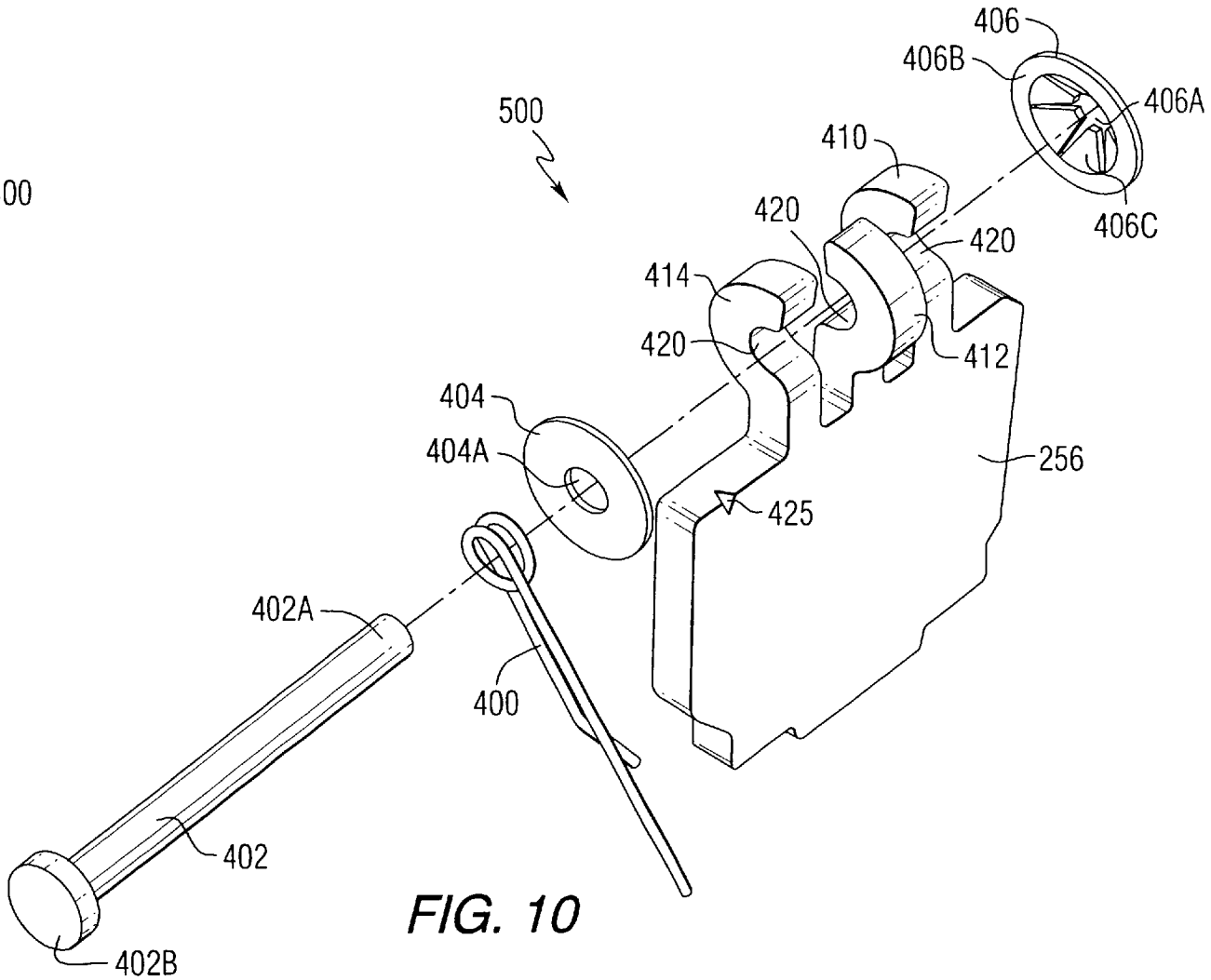
FIG. 10 is an exploded view of the pivot pin assembly of the automatic trip assembly shown in FIG. 3A.

Referring now to FIG. 6 and to FIG. 10, shown is magnetic clapper 256 of automatic trip assembly 250, both in isolation and in connection with a pivot pin assembly 500. Magnetic clapper 256 is substantially planar in form and includes shoulders 313 and 315, with the outside corner of shoulder 315 including a chamfered region or cutout 317. Clapper 256 includes a bottom portion 319, and protruding upwardly from the top of clapper 256, in the exemplary embodiment, are hook-like members 410, 412, and 414. Hook-like members 410 and 414 face the same direction, while middle hook-like member 412 faces the opposite direction. Each hook-like member includes a rounded recess 420 for reasons discussed below. Clapper 256 also includes a groove or indent 425 for reasons discussed below, and is formed of carbon steel material in the exemplary embodiment.

Figure 7B:
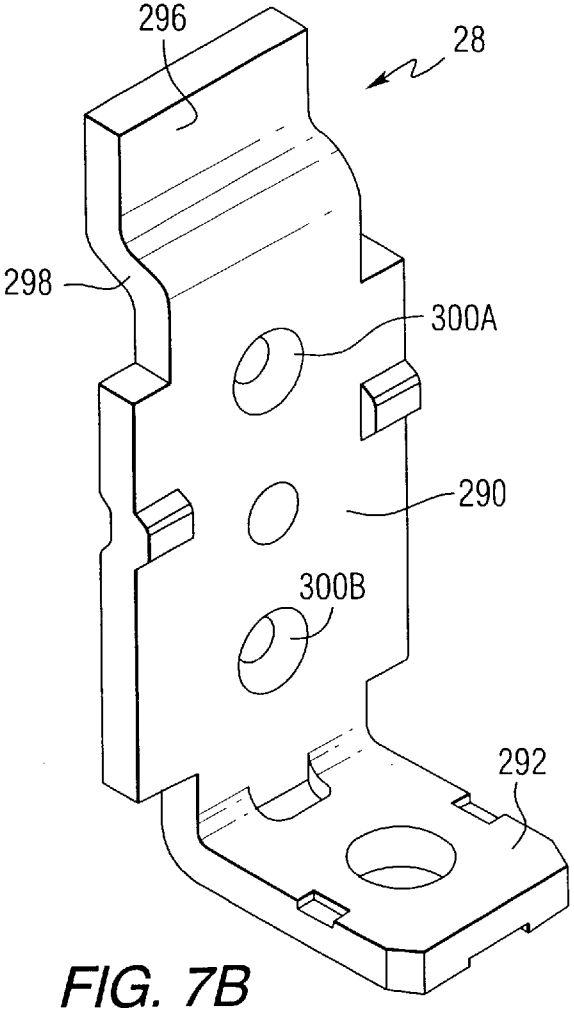
FIGS. 7A and 7B are orthogonal views of the load terminal of the automatic trip assembly shown in FIG. 3A.
Figure 7A:
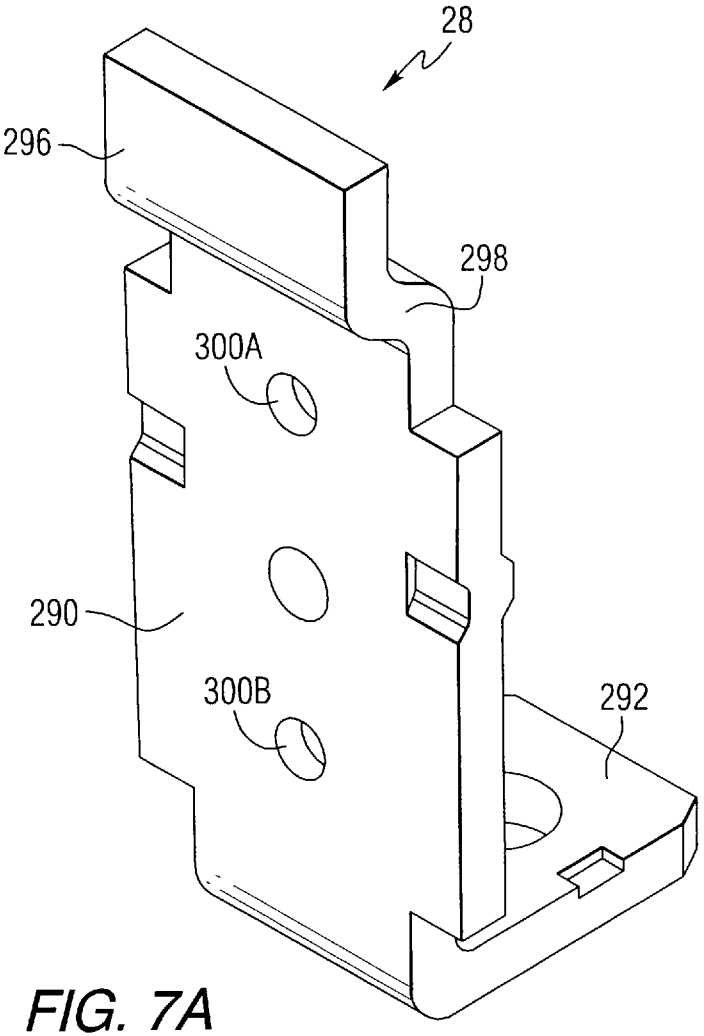

Referring now to FIGS. 7A and 7B, shown in isolation is load terminal 28 of automatic trip assembly 250. Load terminal 28 includes a substantially planar portion 290 from which protrudes, in approximately perpendicular fashion, a bottom connector portion 292 that connects with an external input of electrical current by means of a connecting device such as a self-retaining collar which provides both a physical and electrical connection. Located at the other end of terminal 28 is a top substantially planar region 296 which is offset from portion 290 via a curved region 298. Formed through portion 290 are holes or openings 300A and 300B.

Figure 8:
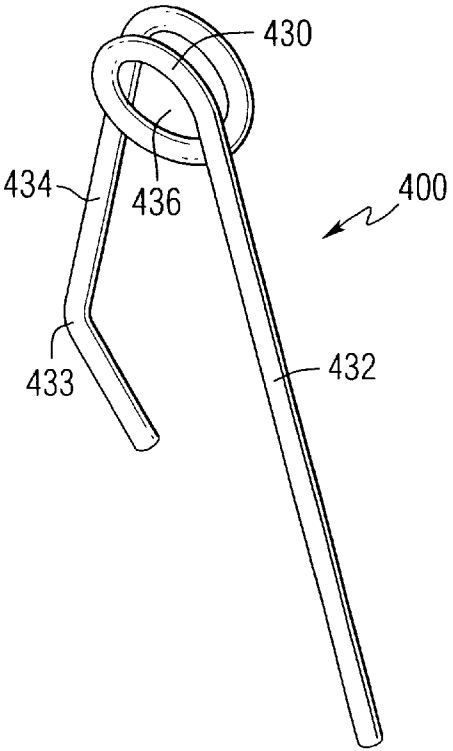
FIG. 8 is an orthogonal view of the torsion spring of the automatic trip assembly shown in FIG. 3A.

Referring now to FIG. 8, shown in isolation is torsion spring 400 of automatic trip assembly 250. Spring 400 is formed of stainless steel material of 0.021 wire diameter in the exemplary embodiment, and includes a coiled region 430 from which extends a first leg 432 and a shorter second leg 434. Second leg 434 includes a bent region 433 in the exemplary embodiment. Formed through coiled region 430 is an opening 436.

Figure 9B:
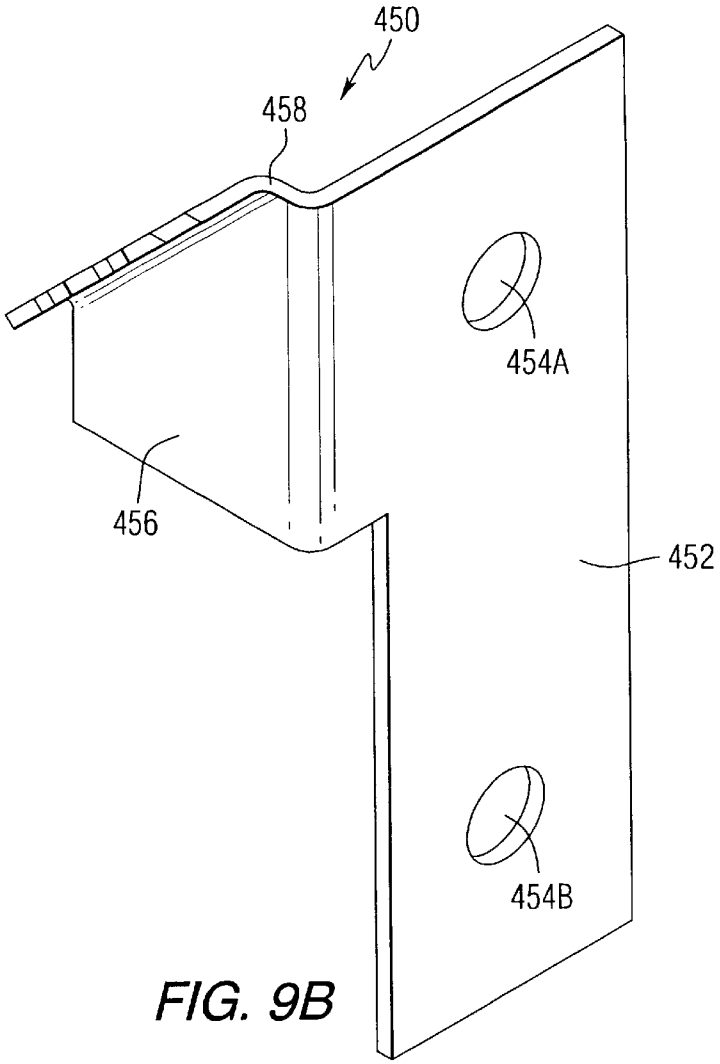
FIGS. 9A, 9B, and 9C are orthogonal views of the protrusion platform of the automatic trip assembly shown in FIG. 3A.
Figure 9A:
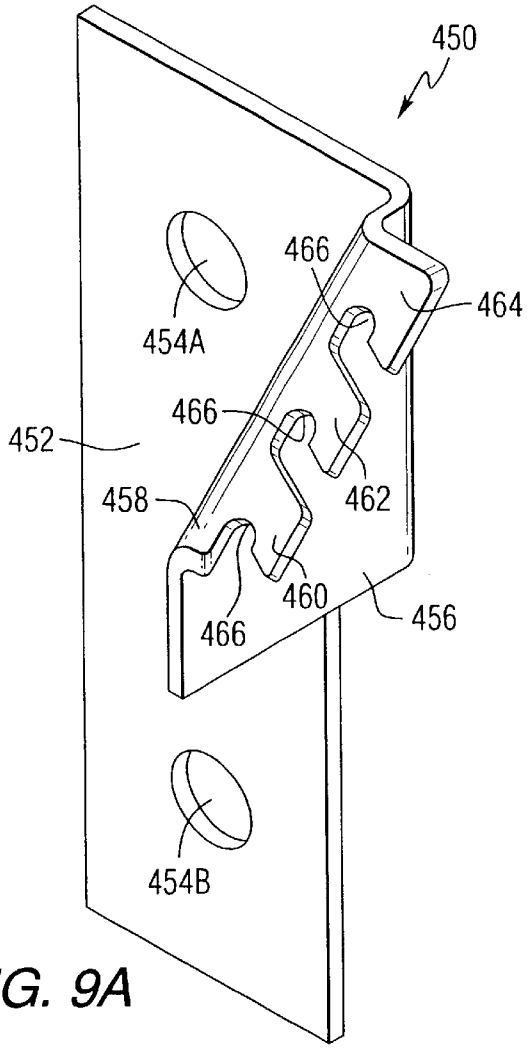
Figure 9C:
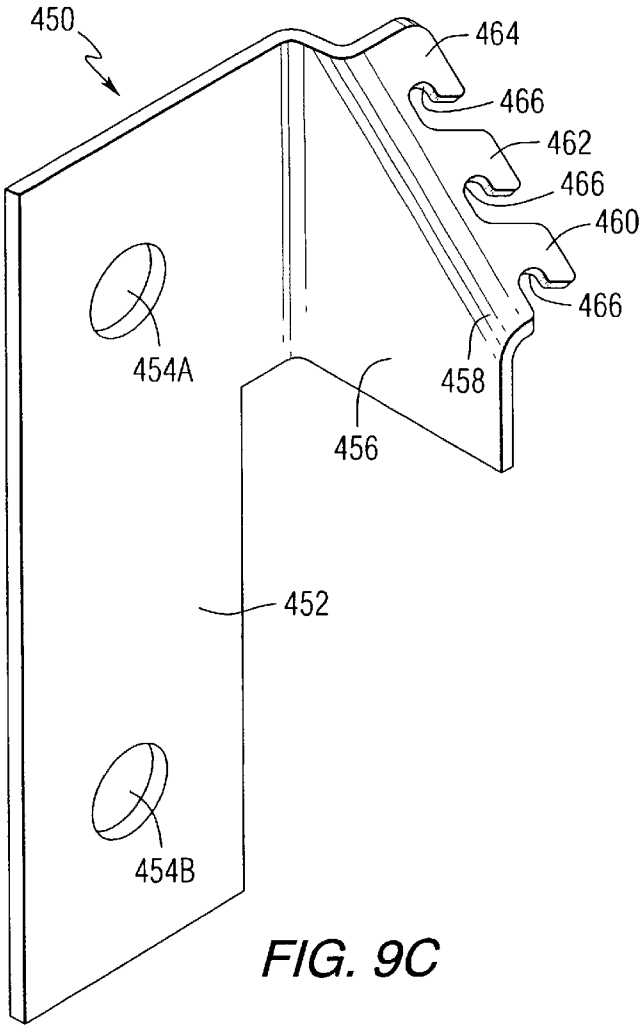

Referring now to FIGS. 9A, 9B, and 9C, shown in isolation is protrusion platform 450 of automatic trip assembly 250. Protrusion platform 450 of the exemplary embodiment is formed of carbon steel material of 0.015 thickness, and includes a planar portion 452 through which are formed holes or openings 454A and 454B, for purposes described below. Extending from planar portion 452, at approximately a right angle, is a side plate 456, the top of which is bent at a diagonal angle and forms a curved region 458. Extending from curved region 458 are hook-shaped protrusion or abutment members 460, 462, and 464, each of which includes a curved recess 466.

Referring now again to FIG. 10, shown is an exploded view of a pivot pin assembly 500 that includes magnetic clapper 256, pivot pin 402, torsion spring 400, washer 404, and end cap 406. Pivot pin 402 is made of steel or brass material in the exemplary embodiment, and includes a first end 402A and a head portion 402B at its other end. Washer 404 is made of carbon steel material in the exemplary embodiment, and is of conventional design including a central opening 404A. End cap 406 is made of spring steel material in the exemplary embodiment, and includes a central opening 406A, an outer ring 406B, and a plurality of flexible panels 406C that extend radially in concave fashion towards opening 406A.

As shown in FIG. 10, pivot pin assembly 500 is assembled by the insertion of end 402A of pivot pin 402 through opening 436 of torsion spring 400, through opening 404A of washer 404, through the series of hook-like members 414, 412, and 410 of clapper 256 whereby the rounded recess 420 of each is engaged, and finally through opening 406A of end cap 406 whereby flexible panels 406C are forced to bend slightly outward to create a snug fit.

FIGS. 3A, 3B, and 3C show automatic trip assembly 250 in its totally assembled form. Neck 284 of bimetal 254 is positioned between arms 260 and 262 of yoke 252 whereby bimetal 254 is substantially parallel (but not in contact) with portion 258 of yoke 252. A screw 255 is shown partially screwed into one side of opening 288 in bottom portion 287 of bimetal 254, for reasons discussed below. Head portion 286 of bimetal 254 is connected to top region 296 of load terminal 28 by way of a conventional heat welding or brazing process, with curved region 298 of load terminal 28 positioned above shoulder 272 of yoke 252. Positioned between yoke 252 and load terminal 28 is protrusion platform 450. Specifically, planar portion 452 of platform 450 is sandwiched between, and in contact with, planar portion 258 of yoke 252 and planar portion 290 of terminal 28. Securing terminal 28, platform 450, and yoke 252 together are securing devices such as rivets 330 which are inserted into holes 274A and 274B of yoke 252 and corresponding holes 454A and 454B of platform 450 and holes 300A and 300B of terminal 28. Secured as such, side plate 456 of protrusion platform 450 is positioned adjacent to side 260 of yoke 252. As best seen in FIG. 3C, positioned in contact with (seated in) pivot surfaces 268 and 270 of yoke 252 is pivot pin 402 of an assembled pivot pin assembly 500. Specifically, a portion of pivot pin 402, between the position of washer 404 and the position of hook-like member 414 of clapper 256, is seated in contact with pivot surface 268, and a portion of pivot pin 402, between the position of hook-like member 410 and the position of end cap 406, is seated in contact with pivot surface 270. With pivot pin assembly 500 seated as such, a limited range of rotational motion is provided for clapper 256 by way of the rotation of hook-like members 410, 412, and 414 (positioned between pivot supports 264 and 266 of yoke 252) about pivot pin 402. During operation of circuit breaker 10, retaining members 263 and retaining protrusions 267 of yoke 252 help maintain pivot pin 402 in contact with pivot surfaces 268 and 270.

As described above with respect to FIG. 10 and shown in FIGS. 3A, 3B, and 3C, coiled region 430 of torsion spring 400 is secured between head portion 402B of pivot pin 402 and washer 404. As best seen in FIG. 3A, second leg 434 of spring 400 is abuttingly seated in groove or indent 425 of clapper 256, and first leg 432 is abuttingly positioned in curved recess 466 of one of the rigidly disposed protrusion members of protrusion platform 450. In particular, first leg 432 is shown abuttingly positioned in curved recess 466 of protrusion member 464. Torsion spring 400 is of appropriate size and shape whereby the tension acting therein to maintain the separation between first leg 432 and second leg 434 is of sufficient strength to cause clapper 256 to be rotationally displaced by second leg 434 in a clockwise manner from vertical (see FIG. 3C and FIG. 2) whereby a predetermined distance is maintained between bottom portion 319 of clapper 256 and front faces 260A and 262A of magnetic yoke 252. Stops or protrusions 265 of pivot supports 264 and 266 are positioned to make contact with a clockwise rotated clapper 256, defining a maximum angle of rotational displacement of clapper 256.

When implemented in circuit breaker 10 as shown in FIG. 2, automatic trip assembly 250 operates to cause a clockwise rotation of trip bar assembly 190, thereby releasing cradle 72 which leads to the TRIPPED disposition, whenever overcurrent conditions exist in the ON disposition. In the ON disposition as shown in FIG. 2, electrical current flows (in the following or opposite direction) from load terminal 28, through magnetic yoke 252 and bimetal 254, from bottom portion 287 of bimetal 254 to movable contact arm 50 through a conductive cord 289 (shown in FIG. 2) that is welded therebetween, through closed contacts 52 and 56, and from stationary contact arm 54 to line terminal 29. Automatic trip assembly 250 reacts to an undesirably high amount of electrical current flowing through it, providing both a thermal and a magnetic tripping operation.

The thermal tripping operation of automatic trip assembly 250 is attributable to the reaction of bimetal 254 to current flowing therethrough. The temperature of bimetal 254 is proportional to the magnitude of the electrical current. As current magnitude increases, the heat buildup in bimetal 254 has a tendency to cause bottom portion 287 to deflect (bend) to the left (as viewed in FIG. 2). When non-overcurrent conditions exist, this deflection is minimal. However, above a predetermined current level, the temperature of bimetal 254 will exceed a threshold temperature whereby the deflection of bimetal 254 causes bottom portion 287 to make contact with a thermal trip bar or member 194 (FIG. 2) of trip bar assembly 190. This contact forces assembly 190 to rotate in the clockwise direction, thereby releasing cradle 72 which leads to the TRIPPED disposition. The predetermined current level (overcurrent) that causes this thermal tripping operation can be adjusted in a conventional manner by changing the size and/or shape of bimetal 254. Furthermore, adjustment can be made by selectively screwing screw 255 (FIG. 3) farther into opening 288 such that it protrudes to a certain extent through the other side of bimetal 254 (towards thermal trip member 194). Protruding as such, screw 255 is positioned to more readily contact thermal trip member 194 (and thus rotate assembly 190) when bimetal 254 deflects, thus selectively reducing the amount of deflection that is necessary to cause the thermal tripping operation.

Automatic trip assembly 250 also provides a magnetic tripping operation. As electrical current flows through magnetic yoke 252, a magnetic field is created having a strength that is proportional to the magnitude of the current. This magnetic field generates an attractive force that has a tendency to pull magnetic clapper 256 towards front faces 260A and 262A of yoke 252. When non-overcurrent conditions exist, the bias force provided by torsion spring 400 prevents any substantial counter-clockwise rotation of clapper 256. However, above a predetermined current level, a threshold level magnetic field is created that overcomes the spring force, enabling bottom portion 319 of clapper 256 to forcefully rotate counter-clockwise towards front faces 260A and 262A of yoke 252. During this rotation, bottom portion 319 of clapper 256 makes contact with magnetic trip bar or member 196 which, as shown in FIG. 2, is partially positioned between clapper 256 and front faces 260A and 262A of yoke 252. This contact moves the end of trip bar 196 substantially between sides 260 and 262 of yoke 252, thereby forcing trip bar assembly 190 to rotate in the clockwise direction. This leads to the TRIPPED disposition.

As with the thermal tripping operation, the predetermined current level that causes the aforementioned magnetic tripping operation can be adjusted. Adjustment may be accomplished by implementation of a different sized (wire diameter) or configured torsion spring 400, or one of different material, thereby reducing or increasing the spring tension. However, adjustment is more conveniently made by selecting a different protrusion member against which first leg 432 abuts. Abutment with protrusion member 464, as shown in FIG. 3A, provides the least amount of force against clapper 256 by second leg 434. Due to the positioning of first leg 432 closer to clapper 256, abutment of first leg 432 with protrusion member 462 provides increased force against clapper 256, and abutment with protrusion member 460 provides the greatest force against clapper 256. By increasing the force against clapper 256, the threshold level magnetic field needed to overcome the spring force is increased, thus increasing the predetermined current level that causes a magnetic tripping operation to occur. With three protrusion members, protrusion platform 450 of the exemplary embodiment provides three levels of adjustment. However, a greater or lesser number of protrusion members, corresponding to a greater or lesser number of adjustment levels, may be employed in alternative embodiments.

It should be noted that the curved recess 466 provided in each of protrusion members 460, 462, and 464 provides for a more seated disposition of first leg 432 of torsion spring 400 that helps to prevent dislodgment of first leg 432 from its abutted position. Such secured engagement of first leg 432 is very beneficial since shock forces and other forces can be generated during high current interruption. In addition, groove or indent 425 of clapper 256 operates in a similar manner to maintain proper positioning of second leg 434 of torsion spring 400 and to prevent it from sliding off of clapper 256.

Figure 11:
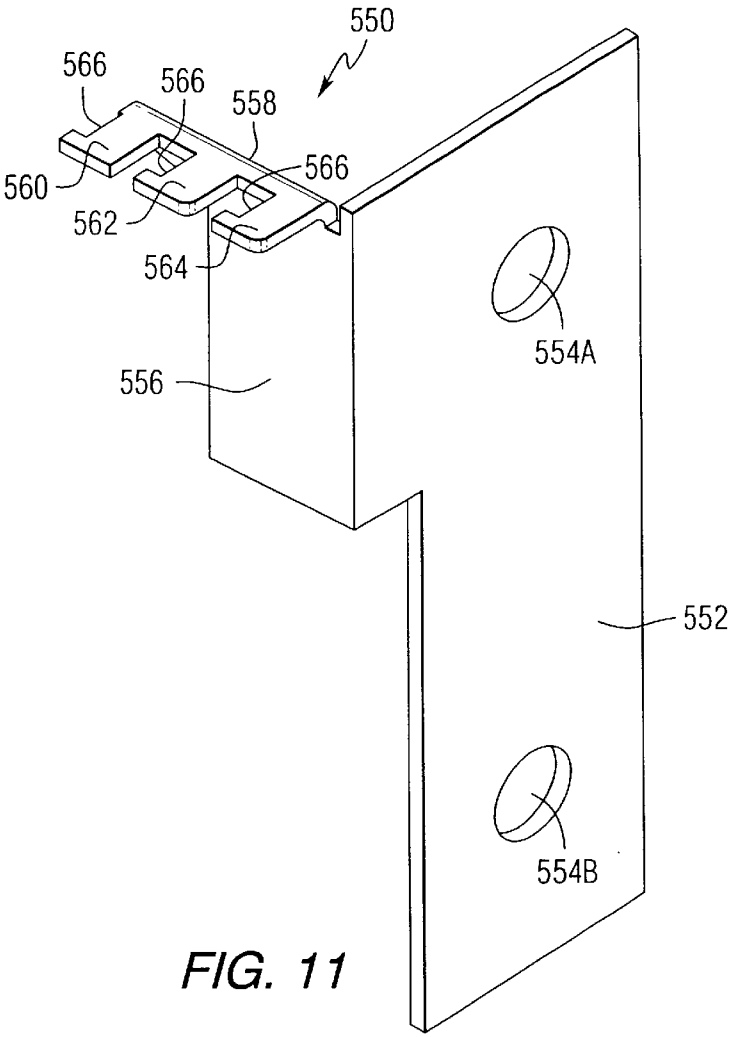
FIG. 11 is an orthogonal view of an alternative embodiment of the protrusion platform.

Shown in FIG. 11 is an alternative embodiment of the protrusion platform of the present invention. Similar to platform 450 of FIGS. 9A, 9B, and 9C, platform 550 includes a planar portion 552 through which are formed holes or openings 554A and 554B, and a side plate 556. However, unlike side plate 456 of platform 450, the top of side plate 556 is not bent at a diagonal angle. Instead, it forms a curved region 558 from which extend horizontally-aligned hook-shaped protrusion members 560, 562, and 564, each of which includes a recess 566. Protrusion platform 550 is positioned within automatic trip assembly 250 as described above in connection with platform 450, and operates in a similar manner.

The present invention is very advantageous in that it provides effective armature biasing while enabling the biasing level to be adjusted in an easy and time-efficient manner. The present invention is also very advantageous in that it provides a more controlled pivot point for the armature that provides smoother and more predictable movement of the armature.

Although the preferred embodiment of the present invention has been described with a certain degree of particularity, various changes to form and detail may be made without departing from the spirit and scope of the invention as hereinafter claimed.

We claim:

1. A circuit interrupter comprising:

a housing;

separable main contacts within said housing;

an operating mechanism within said housing and interconnected with said separable main contacts; and a trip mechanism within said housing and having an automatic trip assembly for generating a tripping operation to cause said operating mechanism to open said contacts upon a predetermined current threshold, said automatic trip assembly including a magnetic yoke, an armature having an armature inner side facing said magnetic yoke, a protrusion member, and an electrical terminal, said magnetic yoke having pivot supports providing for a rotatable disposition of a head portion of said armature, said automatic trip assembly further including a torsion spring having a first leg and a second leg, said first leg abutted against said protrusion member and prevented from moving in a direction away from said armature, said second leg abutted against said armature inner side and applying a force to said armature inner side in a direction to normally rotationally displace a bottom portion of said armature away from said magnetic yoke.

2. The circuit interrupter as defined in claim 1 wherein said automatic trip assembly includes a protrusion platform from which said protrusion member extends.

3. The circuit interrupter as defined in claim 2 wherein said protrusion platform includes a planar portion that is secured between said magnetic yoke and said electrical terminal.

4. The circuit interrupter as defined in claim 2 wherein said protrusion platform includes a plurality of said protrusion members, and wherein said first leg of said torsion spring may be abutted against any one of said plurality of said protrusion members.

5. The circuit interrupter as defined in claim 4 wherein selecting a different one of said plurality of said protrusion members to be said one against which said first leg is abutted causes said force applied to said armature to vary.

6. The circuit interrupter as defined in claim 1 wherein said automatic trip assembly includes a plurality of said protrusion members, and wherein said first leg of said torsion spring may be abutted against any one of said plurality of said protrusion members.

7. The circuit interrupter as defined in claim 6 wherein selecting a different one of said plurality of said protrusion members to be said one against which said first leg is abutted causes said force applied to said armature to vary.

8. The circuit interrupter as defined in claim 1 wherein said magnetic yoke includes a side having an outer surface, and wherein said protrusion member is positioned adjacent to said outer surface.

9. The circuit interrupter as defined in claim 1 wherein said protrusion member includes a recess formed therein in which said first leg is seated.

10. The circuit interrupter as defined in claim 1 wherein said protrusion member is hook-shaped.

11. The circuit interrupter as defined in claim 1 wherein said automatic trip assembly further includes a pivot pin positioned on said pivot supports of said magnetic yoke and to which is connected said head portion of said armature, and wherein said torsion spring includes a coiled region from which said first leg and said second leg extend, said coiled region mounted on said pivot pin.

12. The circuit interrupter as defined in claim 1 wherein said armature includes an indent in which said second leg is seated.

13. A circuit interrupter comprising:

a housing;

separable main contacts within said housing;

an operating mechanism within said housing and interconnected with said separable main contacts; and a trip mechanism within said housing and having an automatic trip assembly for generating a tripping operation to cause said operating mechanism to open said contacts upon a predetermined current threshold, said automatic trip assembly including a magnetic yoke, an armature having an armature inner side facing said magnetic yoke, a protrusion platform from which extends a plurality of protrusion members, and an electrical terminal, said magnetic yoke having pivot supports providing for a rotatable disposition of a head portion of said armature, said automatic trip assembly further including a torsion spring having a first leg and a second leg, said first leg abutted against a selected one of said plurality of protrusion members and prevented from moving in a direction away from said armature, said second leg abutted against said armature inner side and applying a force to said armature inner side in a direction to normally rotationally displace a bottom portion of said armature away from said magnetic yoke.

14. The circuit interrupter as defined in claim 13 wherein said protrusion platform includes a planar portion that is secured between said magnetic yoke and said electrical terminal.

15. The circuit interrupter as defined in claim 13 wherein selecting a different one of said plurality of protrusion members to be said selected one against which said first leg is abutted causes said force applied to said armature to vary.

16. The circuit interrupter as defined in claim 13 wherein each of said plurality of protrusion members includes a recess formed therein in which said first leg may be seated.

17. The circuit interrupter as defined in claim 13 wherein said automatic trip assembly further includes a pivot pin positioned on said pivot supports of said magnetic yoke and to which is connected said head portion of said armature, and wherein said torsion spring includes a coiled region from which said first leg and said second leg extend, said coiled region mounted on said pivot pin.

18. The circuit interrupter as defined in claim 13 wherein said armature includes an indent in which said second leg is seated.

19. A circuit interrupter comprising:

a housing;

separable main contacts within said housing;

an operating mechanism within said housing and interconnected with said separable main contacts; and a trip mechanism within said housing and having an automatic trip assembly for generating a tripping operation to cause said operating mechanism to open said contacts upon a predetermined current threshold, said automatic trip assembly including a magnetic yoke, an armature having an armature inner side facing said magnetic yoke, and a plurality of abutment members, said magnetic yoke having pivot supports providing for a rotatable disposition of a head portion of said armature, said automatic trip assembly further including a torsion spring having a first leg and a second leg, said first leg abutted against a selected one of said plurality of abutment members and prevented from moving in a direction away from said armature, said second leg abutted against said armature inner side and applying a force to said armature inner side in a direction to normally rotationally displace a bottom portion of said armature away from said magnetic yoke, wherein selecting a different one of said plurality of abutment members to be said selected one causes said force to vary.

* * * * *